US011489261B2

(12) United States Patent
Xue et al.

(10) Patent No.: US 11,489,261 B2
(45) Date of Patent: Nov. 1, 2022

(54) DUAL-POLARIZED WIDE-STOPBAND FILTERING ANTENNA AND COMMUNICATIONS DEVICE

(71) Applicant: SOUTH CHINA UNIVERSITY OF TECHNOLOGY, Guangzhou (CN)

(72) Inventors: Quan Xue, Guangzhou (CN); Wanchen Yang, Guangzhou (CN); Wenquan Che, Guangzhou (CN); Yingqi Zhang, Guangzhou (CN); Yongzheng Li, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 65 days.

(21) Appl. No.: 17/149,113

(22) Filed: Jan. 14, 2021

(65) Prior Publication Data

US 2022/0085507 A1 Mar. 17, 2022

(30) Foreign Application Priority Data

Sep. 15, 2020 (CN) ..... 202010965272.0

(51) Int. Cl.
*H01Q 9/04* (2006.01)
*H01Q 1/48* (2006.01)
*H01Q 25/00* (2006.01)

(52) U.S. Cl.
CPC ..... *H01Q 9/045* (2013.01); *H01Q 1/48* (2013.01); *H01Q 25/001* (2013.01)

(58) Field of Classification Search
CPC .. H01Q 1/38–48; H01Q 9/0407; H01Q 9/045; H01Q 25/001
See application file for complete search history.

(56) References Cited

U.S. PATENT DOCUMENTS 7,119,745 B2 * 10/2006 Gaucher ..... H01Q 9/26 343/846
8,350,771 B1 * 1/2013 Zaghloul ..... H01Q 5/40 343/769
10,505,279 B2 * 12/2019 Celik ..... H01Q 9/0428

* cited by examiner

*Primary Examiner* — Hasan Islam
(74) *Attorney, Agent, or Firm* — JMB Davis Ben-David

(57) ABSTRACT

The present invention discloses a dual-polarized wide-stopband filtering antenna and a communications device, the antenna comprising a dielectric substrate, a metal ground plate, a metal radiating patch, metal feeding arms, a metal square ring stub, metal transverse stubs, and metal probes, wherein the dielectric substrate is a rectangular cavity structure, the metal ground plate is disposed on the bottom surface of the dielectric substrate, and the metal radiating patch is disposed in the middle of the top surface of the dielectric substrate; the metal transverse stubs and the metal square ring stub are located inside the rectangular cavity and are connected on the same layer; the metal feeding arms are located between the metal square ring stub and the metal radiating patch; one end of the metal probe and a circular hole disposed on the metal ground plate form a coaxial feeding structure, and the other end of the metal probe is linked with the midpoint of the metal transverse stub and it is simultaneously connected to one end of the metal feeding arm to form a dual-polarized differential feeding structure; and the metal probes are connected to the metal transverse stubs. The antenna has a simple structure, can greatly reduce the volume of a radio frequency front end, and has no additional insertion loss.

10 Claims, 4 Drawing Sheets

DUAL-POLARIZED WIDE-STOPBAND FILTERING ANTENNA AND COMMUNICATIONS DEVICE

CROSS-REFERENCE TO RELATED APPLICATION

Benefit is claimed to Chinese Patent Application No. 202010965272.0, filed Sep. 15, 2020, the contents of which are incorporated by reference herein in their entirety.

Technical Field

The present invention relates to the field of antennas, and specifically to a dual-polarized wide-stopband filtering antenna and a communications device.

Background Art

With the advent of the 5G era, the development of massive multiple-input multiple-output (MIMO) antenna technology has become the key to 5G applications. In order to accommodate more radio frequency transceiver channels in a limited space to cover broadband applications, the development of communications systems trends towards miniaturization, low power consumption, and multi-functionality. Antennas and filters at the front end of a radio frequency system are indispensable passive components, and the performance design thereof is particularly important. The main function of the filter is to filter out noise and unwanted clutter, and the antenna is a terminal component for receiving and transmitting signals. Usually, the antenna and the filter work separately, which not only increases system loss and reduces overall efficiency, but also results in relatively large geometric dimensions. In order to optimize the overall performance of the radio frequency front end, domestic and overseas researchers have proposed the concept and design of a filtering antenna (filtering antenna/filtenna), which combines the functions of the filter and the antenna into one passive component to implement two functions: filtering and radiation. Such a design can not only reduce the geometric dimensions of the system, but can also reduce insertion loss and improve the overall efficiency of the system. Therefore, the design of a filtering antenna applied to different communications systems is very meaningful.

In the design of a 5G base station of MIMO technology, inter-array decoupling and miniaturization are major challenges for an array design. Channels of a plurality of frequency bands are clustered in a limited space, and their mutual coupling will severely affect the efficiency and radiation pattern of the antenna array. Conventional methods for improving the isolation between antenna sub-arrays of different frequencies are, for example, loading a duplexer, or loading a decoupling network between arrays. However, these methods will increase the design difficulty or increase array gaps, making it difficult to miniaturize. In contrast, an array composed of filtering antenna units can make antenna units of different frequency bands compact and nested, reducing the volume of the multi-frequency antenna array. Because the antenna element has a good out-of-band suppression function, units operating in different frequency bands will not interfere with each other, and coupling between adjacent antenna units is also greatly suppressed. Such a design not only meets the system miniaturization requirement, but can also reduce insertion loss of additional components and circuits.

In the millimeter wave frequency band of 5G communications, in order to implement multi-functionality, miniaturization, and low power consumption of the system, the use of three-dimensional integrated vertical packaging technology to integrate multiple system modules has become a development trend. The antenna itself is a distributed device, and the filter has a low Q factor in the millimeter wave frequency band and it is difficult to fully integrate same in a chip. Therefore, both the antenna and the filter need to be connected to a back-end chip through an interconnection structure. The loss of such a design is relatively large and further miniaturization is difficult. Therefore, a filtering antenna design of a "packaged integrated antenna" that can be applied to millimeter wave and higher frequency bands may be one of the methods to solve this problem.

SUMMARY OF THE INVENTION

In order to overcome the disadvantages and drawbacks in the prior art, the primary objective of the present invention is to provide a millimeter wave dual-polarized wide-stopband filtering antenna based on LTCC technology. The antenna can achieve a higher gain and better filtering performance in the millimeter wave frequency band.

The secondary objective of the present invention is to provide a communications device.

The technical solutions used in the present invention are as follows:

A millimeter wave dual-polarized wide-stopband filtering antenna is provided, comprising a dielectric substrate, a metal ground plate, a metal radiating patch, metal feeding arms, a metal square ring stub, metal transverse stubs, and metal probes, wherein the dielectric substrate is a rectangular cavity structure, the metal ground plate is disposed on the bottom surface of the dielectric substrate, and the metal radiating patch is disposed in the middle of the top surface of the dielectric substrate; the metal transverse stubs and the metal square ring stub are located inside the rectangular cavity and are connected on the same layer; the metal feeding arms are located between the metal square ring stub and the metal radiating patch; one end of the metal probe and a circular hole disposed on the metal ground plate form a coaxial feeding structure, and the other end of the metal probe is linked with the midpoint of the metal transverse stub and it is simultaneously connected to one end of the metal feeding arm to form a dual-polarized differential feeding structure; and the metal probes are connected to the metal transverse stubs.

There are four metal transverse stubs in total, which are respectively connected to midpoints of four sides of the metal square ring stub.

There are four metal feeding arms in total, one end of which is connected to the metal probe, and the other end of which points to the vertical middle axis of the rectangular cavity.

The metal probes are vertically disposed.

The metal radiating patch is a square with a side length of 0.2 $\lambda g_0$ to 0.7 $\lambda g_0$, where $\lambda g_0$ is a medium effective wavelength corresponding to a center frequency of the antenna.

The length of the metal feeding arm is 0.15 $\lambda g_0$ to 0.4 $\lambda g_0$, and a straight-line distance between two parallel metal feeding arms pointing to each other is 0.05 $\lambda g_0$ to 0.5 $\lambda g_0$, where $\lambda g_0$ is a medium effective wavelength corresponding to a center frequency of the antenna.

Gaps between the metal ground plate, and the metal transverse stubs and the metal square ring stub are 0.002 $\lambda$ to 0.2 $\lambda$; and gaps between the metal feeding arms and the metal ground plate are 0.004 λ to 0.4 λ, where λ is a free space wavelength corresponding to a center frequency.

The length and width of the metal transverse stub are 0.2 $\lambda g_1$ to 0.7 $\lambda g_1$ and 0.01 $\lambda g_1$ to 0.1 $\lambda g_1$, respectively, where $\lambda g_1$ is a medium effective wavelength corresponding to a zero frequency of an upper side frequency of a passband of the antenna.

There are four circular holes in total, each of which is located right under one end of the metal feeding arm and has a diameter of 0.002 λ to 0.1 λ, where λ is a free space wavelength corresponding to a center frequency.

A communications device is provided, comprising the dual-polarized wide-stopband filtering antenna described.

Beneficial effects of the present invention are as follows:

(1) The structure loaded in the present invention comprises the metal square ring stub and the metal transverse stubs. Since there is no additional filtering circuit, the volume and additional loss of a radio frequency front end can be effectively reduced, so that the antenna has a compact structure and a higher gain.

(2) In the present invention, a coupling structure of the metal feeding arms is loaded, and a filtering structure of the metal square ring stub and the metal transverse stubs is loaded, so that the antenna achieves a wider bandwidth while implementing filtering.

(3) In the present invention, the metal square ring stub and the metal transverse stubs are loaded, so that the antenna generates a resonant stopband in a specific frequency band during a feeding process, thereby forming transmission zeros. The plurality of transmission zeros can make the stopband part have a better suppression level and a wider stopband bandwidth, and an upper side frequency of an upper stopband can reach 1.45 center frequencies.

(4) The present invention uses multi-layer low-temperature co-fired ceramic LTCC lamination technology, which is structurally integrated and easy to interconnect with back-end communication system components, and can be applied to a multi-functional fusion design of a 5G large-scale array.

BRIEF DESCRIPTION OF THE DRAWINGS

FIG. 5(*b*) is a schematic diagram of changes of S parameters of a reflection coefficient and polarization isolation with a frequency according to an embodiment of the present invention;

FIG. 6(*b*) is a schematic diagram of a radiation pattern at 29.5 GHz according to an embodiment of the present invention.

DETAILED DESCRIPTION OF EMBODIMENTS

Figure 1:
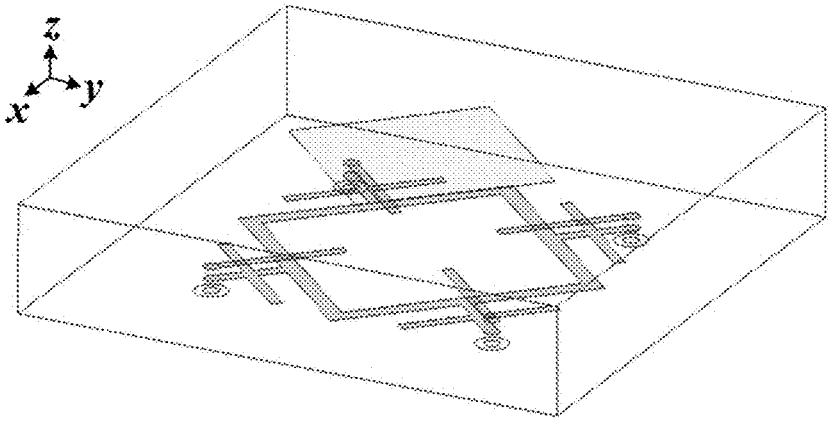
FIG. 1 is a schematic diagram of a three-dimensional structure according to the present invention.

The present invention is further described in detail below in conjunction with embodiments and accompanying drawings, but this does not limit the implementations of the present invention.

EXAMPLE 1

As shown in FIGS. 1 to 4, a dual-polarized wide-stopband filtering antenna, specifically based on LTCC technology, comprises a dielectric substrate 1, a metal ground plate 2, a metal radiating patch 3, metal probes 4, metal feeding arms 8, a metal square ring stub 7, and metal transverse stubs 6. The dielectric substrate is a rectangular LTCC structure, and is specifically a rectangular cavity. The bottom surface of the dielectric substrate is provided with the metal ground plate, and the middle of the top surface of the dielectric substrate is provided with the metal radiating patch 3, the metal radiating patch being a square. The metal transverse stubs and the metal square ring stub are located inside the rectangular cavity on the same layer, and midpoints of the metal transverse stubs are each connected to a side of the metal square ring stub through a segment of metal, that is, the metal transverse stubs are located between the top and bottom surfaces.

As shown in FIG. 1, the metal radiating patch and the metal square ring stub are arranged in the same direction. There is one metal square ring stub 7. The center of the square ring is at the point of origin, and each side of the square ring has an included angle of 45 degrees relative to the x and y axes.

Figure 2:
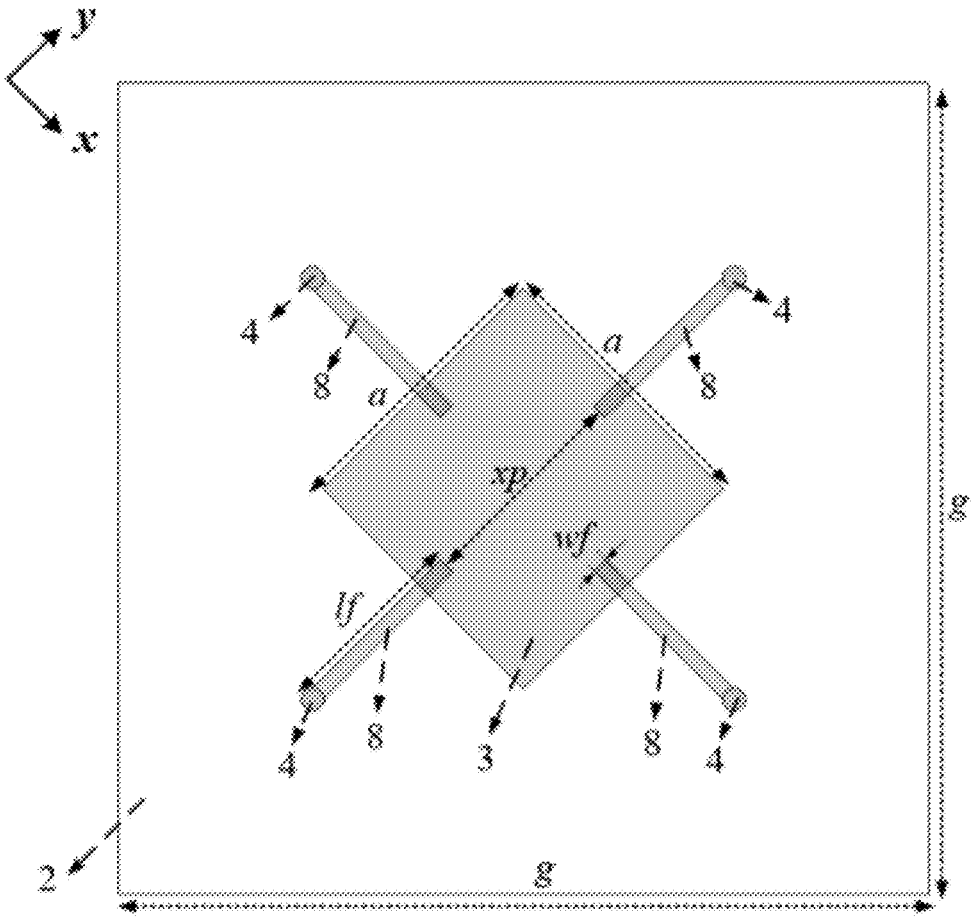
FIG. 2 is an exploded top view of FIG. 1, including a metal radiating patch, a dielectric substrate, metal probes, and metal feeding arms.
Figure 3:
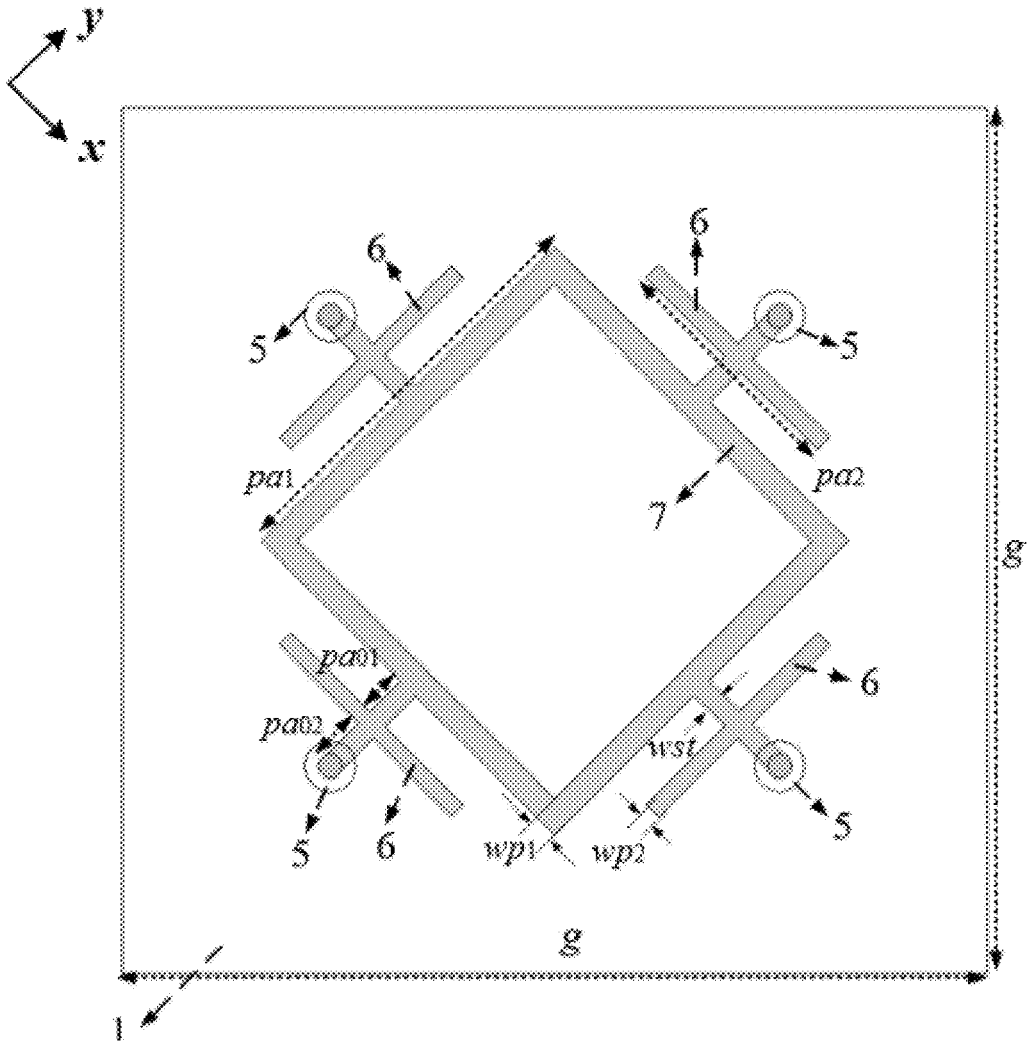
FIG. 3 is an exploded top view of FIG. 1, including metal transverse stubs, a metal square ring stub, and a metal ground plate.
Figure 4:
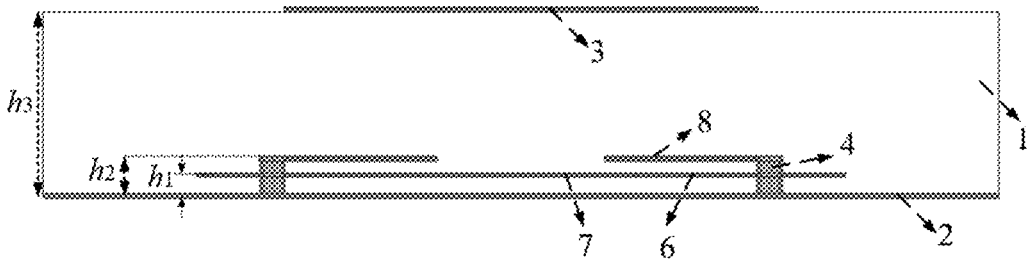
FIG. 4 is a side view of FIG. 1 according to the present invention.

As shown in FIGS. 2, 3, and 4, in order to form resonance in a specific frequency band and generate upper sideband and lower sideband zeros of the antenna to implement part of the filtering function, there are four metal transverse stubs, which are the same in both size and structure and parallel to the four corresponding sides of the metal square ring stub. The midpoints of the four metal transverse stubs are located on the +x, +y, −x, and −y axes and between the point of origin and the metal probes 4, and are close to the metal probes 4. The directions of the stubs are perpendicular to the directions of the +x, +y, −x, and −y axes, and the midpoint of the metal transverse stub 6 is connected to the metal probe 4 through a segment of metal. Distances between the four metal transverse stubs and the four sides of the metal square ring stub are equal.

In order to generate a capacitance effect, couple and feed power to the patch, and broaden an operating bandwidth, the metal feeding arms are located between the layer on which the metal transverse stubs and the metal square ring stub are located and the metal radiating patch, and are specifically perpendicular to the metal transverse stubs. One end of the metal feeding arm is connected to the metal probe, and the other end of the metal feeding arm points to the point of origin in a direction parallel to the direction of the +x, +y, −x, or −y axis.

There are specifically four metal probes, which are vertically disposed in the dielectric substrate 1, with positions of the circle centers thereof located on the +x, +y, −x, and −y axes and having the same distance to the point of origin. One end of the probe and a circular hole 5 disposed on the metal ground plate are concentric to form a coaxial feeding structure, and the other end of the probe is linked with the midpoint of the metal transverse stub 6 and it is simultaneously connected to one end of the metal feeding arm 8, with the purpose of forming a dual-polarized differential feeding structure to implement ±45 degree dual polarization function.

There are four circular holes, each of which corresponds to one end of the metal feeding arm.

Furthermore, the dielectric substrate has the dielectric constant $\varepsilon_r$ of 2 to 7 and the thickness $h_3$ of 0.05 λ to 0.8 λ, where λ is a free space wavelength corresponding to a center frequency. The thickness of the dielectric substrate can be selected within the above range depending on bandwidth requirements and processing implementation capabilities of the antenna, and the filtering function of stopband suppression can be implemented in all cases.

Furthermore, the dielectric substrate and the metal ground plate are rectangular and both have the side length g of 0.2 λ to 1.5 λ, where λ is a free space wavelength corresponding to a center frequency. The side length of two sides of the metal ground plate can be selected within the above range depending on dimension requirements of the antenna, and the filtering function of stopband suppression can be implemented in all cases.

Furthermore, gaps $h_1$ between the metal ground plate, and the metal transverse stubs and the metal square ring stub are 0.002 λ to 0.2 λ; and gaps $h_2$ between the metal feeding arms and the metal ground plate are 0.004 λ to 0.4 λ, where λ is a free space wavelength corresponding to a center frequency. A gap between the dielectric substrate and the metal ground plate, and the gaps between the metal feeding arms and the metal ground plate can be selected within the above range depending on bandwidth requirements of the antenna, and the filtering function of stopband suppression can be implemented in all cases.

Furthermore, the side length a of two sides of the metal radiating patch is 0.2 $\lambda g_0$ to 0.7 $\lambda g_0$, where $\lambda g_0$ is a medium effective wavelength corresponding to a center frequency of the antenna. The side length of the radiating patch can be used to adjust impedance matching in a passband. The side length of the radiating patch depends on the thickness of the dielectric substrate, the dielectric constant, and the gap between the dielectric substrate and the metal ground plate, and the filtering function of stopband suppression can be implemented in all cases within the above range.

Furthermore, the length lf of the metal feeding arm is 0.15 $\lambda g_0$ to 0.4 $\lambda g_0$, and a straight-line distance xp between two parallel metal feeding arms pointing to each other is 0.05 $\lambda g_0$ to 0.5 $\lambda g_0$, where $\lambda g_0$ is a medium effective wavelength corresponding to a center frequency of the antenna. The length and position of the metal feeding arm are used to adjust an operating frequency of a passband of the antenna and impedance matching in the passband.

Furthermore, the length $pa_2$ and width $wp_2$ of the metal transverse stub are 0.2 $\lambda g_1$ to 0.7 $\lambda g_1$ and 0.01 $\lambda g_1$ to 0.1 $\lambda g_1$, respectively, and the length $pa_{02}$ of the junction between the midpoint of the metal transverse stub and the metal probe is 0.01 $\lambda g_1$ to 0.3 $\lambda g_1$, where $\lambda g_1$ is a medium effective wavelength corresponding to a zero frequency of an upper side frequency of a passband of the antenna. The length and width of the metal transverse stub are used to adjust impedance matching in a passband, a zero frequency of an upper side frequency of the passband, and upper stopband suppression performance. The metal transverse stubs are equivalent to a stopband effect of two pairs of parallel ¼ $\lambda g_1$ open-circuit stub lines, generating upper sideband zeros of the antenna. The length of the metal transverse stub mainly depends on the thickness of the dielectric substrate, the dielectric constant, and the gap between the dielectric substrate and the metal ground plate, and the filtering function of stopband suppression can be implemented in all cases within the above range.

Furthermore, the side length $pa_1$ and width $wp_1$ of the metal square ring stub are 0.1 $\lambda g_2$ to 0.5 $\lambda g_2$ and 0.01 $\lambda g_2$ to 0.05 $\lambda g_2$, respectively, and the length $pa_{01}$ and width wst of the junction between the side midpoint of the metal square ring stub and the midpoint of the metal transverse stub is 0.01 $\lambda g_2$ to 0.1 $\lambda g_2$ and 0.01 $\lambda g_2$ to 0.05 $\lambda g_2$, respectively, where $\lambda g_2$ is a medium effective wavelength corresponding to a zero frequency of a lower side frequency of a passband of the antenna. The side length and width of the metal square ring stub are used to adjust impedance matching in a passband, a zero frequency of an upper side frequency of the passband, and lower stopband suppression performance. The total length of the four sides of the metal square ring stub is equivalent to a parallel 1 $\lambda g_2$ stopband resonator, generating lower sideband zeros of the antenna. The length of the metal transverse stub mainly depends on the thickness of the dielectric substrate, the dielectric constant, and the gap between the dielectric substrate and the metal ground plate, and the filtering function of stopband suppression can be implemented in all cases within the above range.

Furthermore, the diameter of the metal probe is between 0.001 λ and 0.05 λ; and the diameter of the circular hole is between 0.002 λ and 0.1 λ, where λ is a free space wavelength corresponding to a center frequency. The circular hole and the metal probe are concentric, the diameter of the circular hole is greater than the diameter of the metal probe, and they form a coaxial interface structure, the specific dimension of which depends on the model of a selected radio frequency coaxial connector.

The specific dimensions in this embodiment are as follows:

The dielectric substrate has a dielectric constant $\varepsilon_r$ of 5.9 and a thickness $h_3$ of 0.846 mm; the dielectric substrate and the metal ground plate are rectangular, the side length g of two sides of which is 5.35 mm; the gaps $h_1$ between the metal ground plate, and the metal transverse stubs and the metal square ring stub are 0.094 mm; and the gaps $h_2$ between the metal feeding arms and the metal ground plate are 0.094 mm. Herein, λ is a free space wavelength corresponding to a center frequency, and $\lambda g_0$, $\lambda g_1$, and $\lambda g_2$ are medium effective wavelengths corresponding to a center frequency, a zero frequency of an upper side frequency of a passband, and a zero frequency of a lower side frequency of a passband, respectively. In this embodiment, the value of λ is 11.16 mm, the value of $\lambda g_0$ is 4.6 mm, the value of $\lambda g_1$ is 3.85 mm, and the value of $\lambda g_2$ is 6.67 mm.

The side length a of the metal radiating patch 3 is 14 mm, the length lf of the metal feeding arm is 1.18 mm, and the straight-line distance xp between the two parallel metal feeding arms pointing to each other is 1.73 mm.

The length $pa_2$ and width $wp_2$ of the metal transverse stub are 1.4 mm and 0.12 mm, respectively, and the length $pa_{02}$ of the junction between the center of the metal transverse stub 6 and the metal probe is 0.25 mm. The side length $pa_1$ and width $wp_1$ of the metal square ring stub are 2.15 mm and 0.13 mm, respectively, and the length $pa_{01}$ and width wst of the junction between the side midpoint of the metal square ring stub and the midpoint of the metal transverse stub are 1.12 mm and 0.11 mm, respectively.

The diameter of the metal probe is 0.2 mm, and the diameter of the circular hole is 0.4 mm.

Figure 5A:
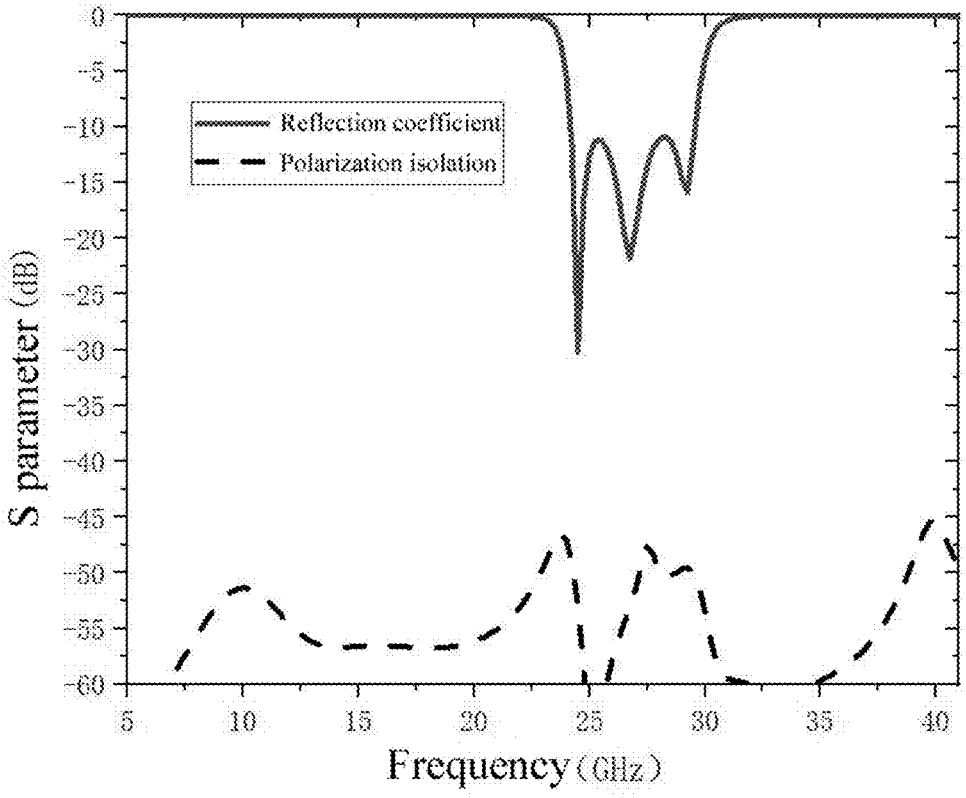
FIG. 5(*a*) is a schematic diagram of changes of a gain with a frequency according to an embodiment of the present invention.
Figure 5B:
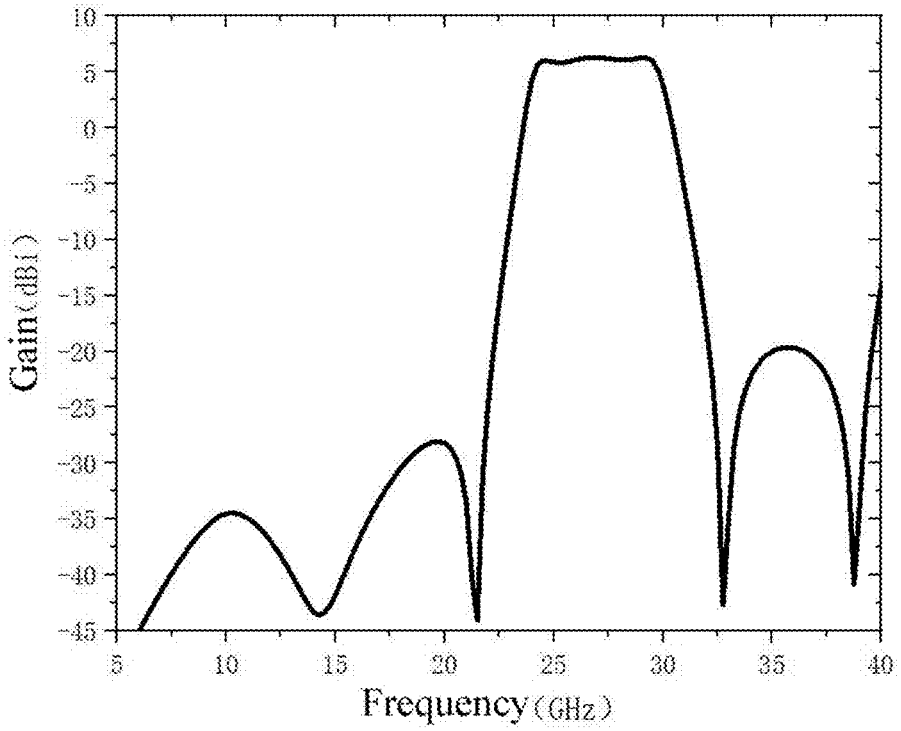

As shown in FIGS. 5(*a*) and 5(*b*), the wide-stopband filtering patch antenna in this embodiment has a high and stable gain in the operating frequency band, with an average gain of 5.9 dBi and a maximum gain of 6.3 dBi; polarization isolation is extremely good, and there is good frequency selectivity at the edge of the operating frequency band; and there is high out-of-band suppression, which is greater than 20 dB, wherein an upper stopband can be suppressed to 1.45 center frequencies. It can be seen that the antenna has good matching at the center frequency and has a wide impedance bandwidth with a bandwidth of 19.5%, which completely covers the millimeter wave frequency band of 5G communications.

Figure 6A:
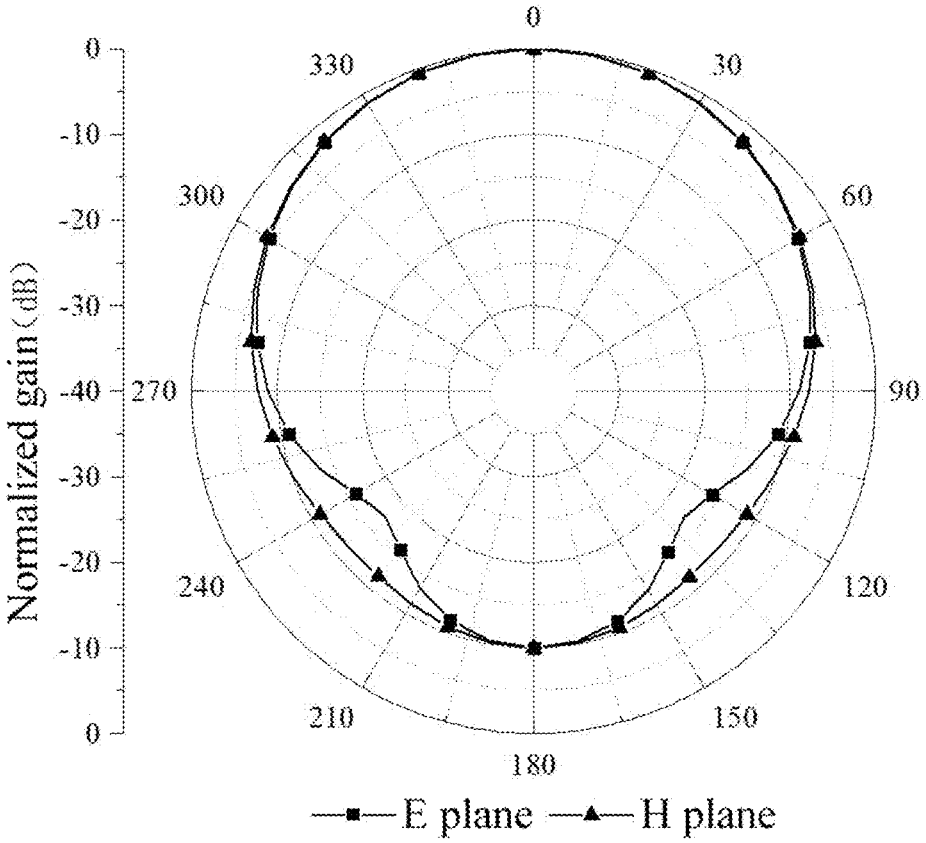
FIG. 6(*a*) is a schematic diagram of a radiation pattern at 24.5 GHz according to an embodiment of the present invention.
Figure 6B:
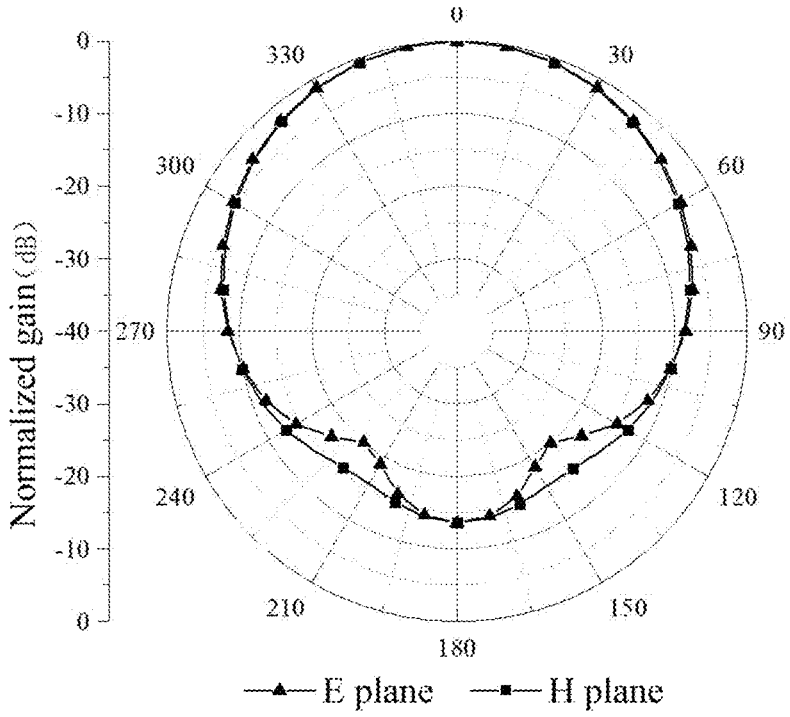

As shown in FIGS. 6(*a*) and 6(*b*), pattern symmetry of the wide-stopband filtering patch antenna in this embodiment is basically good in the passband.

In the millimeter wave dual-polarized wide-stopband filtering antenna provided in this embodiment of the present invention, the metal probe vertically passes through the metal ground plate and the dielectric substrate under the ground plate to be connected to the metal feeding arm, coupling and feeding power to the radiating patch. The antenna loads the metal transverse stubs and the metal square ring stub to generate transmission zeros and additional resonance points in the passband, so as to implement a broadband antenna with a filtering response.

Specifically, the metal transverse stubs in this embodiment are equivalent to a stopband effect of two pairs of parallel ¼ $\lambda g_1$ open-circuit stub lines, generating upper sideband zeros of the antenna. The total length of the four sides of the metal square ring stub is equivalent to a parallel 1 $\lambda g_2$ stopband resonator, generating lower sideband zeros of the antenna. The antenna sideband has good selectivity, and the stopband suppression is good, implementing the filtering response. Since there is no additional filter/resonator or filtering circuit, such a design can greatly reduce the volume of the radio frequency front end, and there is no additional insertion loss; in addition, the introduction of the filtering structure adds capacitive and inductive resonance, which will also affect the impedance of the antenna, thereby introducing a resonance point in the passband, broadening the antenna bandwidth, and implementing filtering in a compact and high-gain structure. The antenna has a simple structure, can greatly reduce the volume of the radio frequency front end without additional insertion loss, and can achieve ±45° dual polarization operation of differential feeding in an integrated structure. In addition, the antenna has the filtering response with high selectivity, wide stopband, and a high stopband suppression level, and is suitable for a fusion design of functions of a 5G millimeter wave base station antenna.

Embodiment 2

A communications device is provided, comprising the dual-polarized wide-stopband filtering antenna described in Embodiment 1.

The above-mentioned embodiments are preferred implementations of the present invention. However, the implementations of the present invention are not limited to the above-mentioned embodiments, and any other changes, modifications, substitutions, combinations, and simplifications made without departing from the spirit and principle of the present invention should all be equivalent replacement methods and should all be included in the scope of protection of the present invention.

We claim:

1. A dual-polarized wide-stopband filtering antenna, comprising:

a dielectric substrate, a metal ground plate, a metal radiating patch, metal feeding arms, a metal square ring stub, metal transverse stubs, and metal probes, wherein the dielectric substrate is a rectangular cavity structure, the metal ground plate is disposed on a bottom surface of the dielectric substrate, and the metal radiating patch is disposed in the middle of a top surface of the dielectric substrate;

the metal transverse stubs and the metal square ring stub are located inside the rectangular cavity and are connected on a same layer;

the metal feeding arms are located between the metal square ring stub and the metal radiating patch;

one end of each of the metal probes and a circular hole disposed on the metal ground plate form a coaxial feeding structure, and another end of each of the metal probes is linked with the midpoint of a respective metal transverse stub of the metal transverse stubs and it is simultaneously connected to one end of a respective metal feeding arm of the metal feeding arms to form a dual-polarized differential feeding structure; and the metal probes are connected to the metal transverse stubs.

2. The filtering antenna as claimed in claim 1, wherein there are four metal transverse stubs in total, which are respectively connected to midpoints of four sides of the metal square ring stub.

3. The filtering antenna as claimed in claim 1, wherein there are four metal feeding arms in total, one end of each of the metal feeding arms is connected to a respective metal probe of the metal probes, and another end of each of the feeding arms points to a vertical middle axis of the rectangular cavity.

4. The filtering antenna as claimed in claim 1, wherein the metal probes are vertically disposed.

5. The filtering antenna as claimed in claim 1, wherein the metal radiating patch is a square with a side length of 0.2 $\lambda g_0$ to 0.7 $\lambda g_0$, where $\lambda g_0$ is a medium effective wavelength corresponding to a center frequency of the antenna.

6. The filtering antenna as claimed in claim 3, wherein a length of the respective metal feeding arms is 0.15 $\lambda g_0$ to 0.4 $\lambda g_0$, and a straight-line distance between two parallel metal feeding arms of the metal feeding arms pointing to each other is 0.05 $\lambda g_0$ to 0.5 $\lambda g_0$, where $\lambda g_0$ is a medium effective wavelength corresponding to a center frequency of the antenna.

7. The filtering antenna as claimed in claim 1, wherein gaps between the metal ground plate, and the metal transverse stubs and the metal square ring stub are 0.002 $\lambda$ to 0.2 $\lambda$; and gaps between the metal feeding arms and the metal ground plate are 0.004 $\lambda$ to 0.4 $\lambda$, where $\lambda$ is a free space wavelength corresponding to a center frequency.

8. The filtering antenna as claimed in claim 1, wherein a length and a width of the metal transverse stubs are 0.2 $\lambda g_1$ to 0.7 $\lambda g_1$ and 0.01 $\lambda g_1$ to 0.1 $\lambda g_1$, respectively, where $\lambda g_1$ is a medium effective wavelength corresponding to a zero frequency of an upper side frequency of a passband of the antenna.

9. The filtering antenna as claimed in claim 1, wherein there are four circular holes in total, each of which is located right under one end a respective metal feeding arm of the metal feeding arms and has a diameter of 0.002 λ to 0.1 λ, where λ is a free space wavelength corresponding to a center frequency.

10. A communications device, comprising the dual-polarized wide-stopband filtering antenna as claimed in claim 1.

* * * * *